US005624020A

United States Patent [19]

Mokler et al.

[11] Patent Number: 5,624,020

[45] Date of Patent: Apr. 29, 1997

[54] DEVICE FOR LINEARLY CONVEYING SHEET LIKE PRODUCTS

[75] Inventors: Bernhard Mokler, Markgröningen; Stephan Gericke, Ostfildern, both of Germany

[73] Assignee: LTG Lufttechnische GmbH, Stuttgart, Germany

[21] Appl. No.: 448,706

[22] Filed: May 24, 1995

[30] Foreign Application Priority Data

Aug. 23, 1994 [DE] Germany ..... 44 29 883.8

[51] Int. Cl.[6] ..... B65G 47/26

[52] U.S. Cl. ..... 198/460.1; 198/464.3; 198/689.1

[58] Field of Search ..... 198/689.1, 357, 198/370.12, 460.1, 464.3

[56] References Cited

U.S. PATENT DOCUMENTS

| | | | |
|---|---|---|---|
| 3,223,225 | 12/1965 | Clark et al. | 198/357 |
| 3,827,545 | 8/1974 | Buhayar . | |
| 4,516,759 | 5/1985 | Kobler . | |
| 4,526,266 | 7/1985 | Dietz | 198/357 |
| 4,632,381 | 12/1986 | Cuir et al. . | |
| 4,995,859 | 2/1991 | Totani . | |
| 5,038,911 | 8/1991 | Doane et al. | 198/357 |
| 5,094,337 | 3/1992 | Van Veldhuisen et al. | 198/357 |
| 5,221,079 | 6/1993 | Most et al. . | |
| 5,265,863 | 11/1993 | Becker . | |
| 5,288,067 | 2/1994 | Stock | 198/689.1 X |
| 5,373,933 | 12/1994 | Planke et al. | 198/689.1 |

FOREIGN PATENT DOCUMENTS

| | | |
|---|---|---|
| 0099054 | 7/1982 | European Pat. Off. . |
| 0408893 | 6/1989 | European Pat. Off. . |
| 0574710 | 6/1992 | European Pat. Off. . |
| 1214249 | 6/1962 | Germany . |
| 2348320 | 9/1973 | Germany . |

OTHER PUBLICATIONS

Abstract of Japanese Publication No. JP 5077995 Sheet Accumulating Device vol. 17 No. 403 28–07–1993 Pat. A 5077995 Patentee: Fuji Photo Film Co. Mar. 1993.

*Primary Examiner*—D. Glenn Dayoan
*Attorney, Agent, or Firm*—Anderson Kill & Olick P.C.

[57] ABSTRACT

A device for linearly conveying sheet-like products, fed with a first speed, to a delivery conveyor or an apparatus having a second speed different from the first speed including a conveying surface provided with suction openings for applying vacuum to the conveying surface for retaining the sheet-like products thereon, and control unit for changing a displacement speed of the conveying surface from the first speed to the second speed and, thereafter, from the second speed to the first speed.

5 Claims, 2 Drawing Sheets

DEVICE FOR LINEARLY CONVEYING SHEET LIKE PRODUCTS

BACKGROUND OF THE INVENTION

The present invention relates to a device for linearly conveying sheet-like products, fed with a first conveyor having a first speed, to a second conveyor or, apparatus having a second speed different from the first speed.

A prior art device of the above-described type includes a conveyor belt, driven with a constant speed, for conveying metal sheets stacked at one location to a piling table spaced from the one location. After the metal sheets leave the conveyor belt, they hit a stop surface and thereby are brought to a stop, with their speed being thus reduced to zero, to be deposited on the piling table.

One of the drawbacks of this known conveying device consists in that the deposited sheet may damage the upper surface of the uppermost sheet of a stack already formed on the piling table. Further, the deceleration to zero speed or braking of the deposited sheets are not easily reproducible for the following sheets. This is because the stackable on the piling table sheets often hit the stop surface at a high speed, so that a back pressure of the braking buffer or the like is applied to the sheets.

EP 0408 893A1 discloses a stacking device for conveying sheets fed at a constant speed, which comprises pull-up rollers arranged side by side for accelerating sheets, which are cut-off by a rotational cutter, in order to space a rear edge of an already cut-off sheet from the front edge of the following sheet that is being cut-off. In the conveying direction of the sheets downstream of the pull-up rollers, there is provided a suction braking table including a conveying suction belt having a displacement speed lower than the speed of the pull-up rollers. After the sheets leave the pull-up rollers, they are received on the suction belt having a reduced speed in comparison with that of the pull-up rollers. It is to be pointed out that both the acceleration of the sheets by the pull-up rollers and the deceleration of the sheets by the suction braking table can result in a damage of the sheets.

German patent No. 2,348,320 describes a stacking device comprising a plurality of suction conveying rollers, spaced from each other a distance smaller than the length of the conveying sheets, and a plurality of suspended strips, which are subjected to air blasts, for feeding flexible sheets to a piling table. Before stacking, the sheets are transferred to the suction conveying rollers, which have a rotational speed lower than the sheet conveying speed, so that the speed of the sheets is reduced to a lower stacking speed as a result of a sliding friction or slippage. However, this device also does not eliminate a possibility of sheet damage.

The prior art discloses also a device for sluicing previously inspected sheets removed from a treatment apparatus or a conveyor. The sluicing device is so formed that the inspected sheet is inserted into the position of the following sheet taken off for inspection. The known sluicing device comprises a ramp-like conveying belt for supporting the sheet in its wait position. Immediately, after taking off of the following sheet, a coupling force lockingly connects the conveying belt with the drive of the conveyor, and the previous sheet is inserted into the "gap" in the conveyor. During acceleration of the previous sheet and during its insertion into the sheet stream conveyed by the conveyor, the relative movement between the sheet and conveying medium may cause damage of the sheets. Further, the known sluicing device does not insure a very accurate sluicing reproducibility. Considering the customary speed and the conventional spacing of the conveyed articles from one another, the sluicing accuracy should lie within a range of 20–100 millisecond. If this accuracy cannot be achieved, the sheets overlap each other, which leads to a damage and disturbances of the conveyor drive. Because of the use of the force-locking connection and because of an associated therewith change of the sluicing time, it is not possible to use the device for an extended period of time, while insuring an accurate sluicing reproducibility. Instead of a coupling connection, a lowering mechanism can be used for sluicing the sheets with a declining drive force and for inserting the sheets into the gaps in the conveyor. These measures, however, hardly permit a damage-free sluicing with the required accuracy.

The prior art also discloses a sheet loading device for a treatment apparatus. The known loading device comprises a flat conveying belt onto which sheets are fed one after another with a high speed. Downstream of the conveying belt, there are provided metal rails on which the conveyed sheets slide. A far away region of the metal rails defines or is formed as a braking region having braking surfaces along which the sheet slides with a reduced speed. The braking surfaces may comprise metal attracting magnets or suction opening. Here also a mechanical damage of sheets takes place. Further, it is not possible to insure transfer of the sheets to the handling or treatment apparatus in a predetermined manner and with an accurate reproducibility.

Accordingly, an object of the invention is a device of types described above which would insure damage-free feeding or delivery of sheet-like products to and from sheet handling apparatuses and arrangements with a precise reproducibility of the kinematic processes.

SUMMARY OF THE INVENTION

Thus and other objects of the invention, which will become apparent hereinafter, are achieved by providing a device comprising a conveying surface provided with suction openings communicating with a vacuum source for applying vacuum to the conveying surface for retaining the sheet-like products thereon, and control means for changing a displacement speed of the conveying surface from the first speed to the second speed and, thereafter, from the second speed to the first speed.

A device described above prevents above-discussed damages of sheet-like products during their feeding to and delivery from sheet handling or treatment apparatuses. The inventive device insures a transfer of sheet-like products from a feeding conveyor onto the conveying surface of the conveying device according to the invention or from the conveying surface at the feeding or delivery speed, without any sliding and, thus, without any possibility of damage of the conveyed sheets. The conveyed, by the conveying surface, sheets are retained on the conveying surface due to the application of vacuum thereto, and the sheet speed is accelerated or decelerated, respectively. The acceleration or deceleration is effected jolt-free in a predetermined manner. In particular, the lower speed is so selected that the delivered sheets can, e.g., be stacked without any damage thereto. Especially, when they are advanced against a resilient stop, no back pressure occurs. The conveying surface, when used for delivery of sheet-like products with a lower speed, after a sheet-like product is removed therefrom, is accelerated again to the speed of the feeding conveyor for slidelessly receiving a following sheet-like product.

Advantageously, the inventive device may be used as a sluicing device arranged downstream of a withdrawal device for sheet-like products in the transporting direction of the sheet-like products. In this case, a sheet-like product taken off from the withdrawal conveyor, e.g., for inspection, after being inspected, is placed into the sluicing device and is retained on the conveyor, without any slippage. Because the sheet is aspirated to the conveying surface and, therefore, does not move relative thereto, no damage of the sheet can take place during the acceleration step.

The inventive device can also be used as a loading device, e.g., for a sheet dryer or the like apparatus. Here also the problems of receiving the sheets fed at a high speed and reproducibly decelerating them in a controlled manner and damage-free are solved by the novel features of the inventive device used as a loading device. The fed sheets are taken over by the conveying surface, displaceable with a substantially the same speed as the feeding conveyor, are aspirated to the conveying surface. The deceleration of the conveying surface is effected, advantageously, when the conveyed sheet is completely transferred to the conveying surface, i.e., when the rear edge of the sheet conveyed by the conveying surface of the loading device, completely leaves the feeding conveyor located upstream of the loading device. When the sheets, conveyed by the loading device, are removed therefrom by a rotatable ramp lever arrangement, displaceable with a lower speed, and are fed to a sheet handling apparatus, e.g., a dryer, by the ramp lever arrangement, it is advantageous that the conveying surface speed and thereby the conveyed sheet speed is decelerated to zero, and the conveying surface comes to a standstill. In this case a damage-free transfer of the sheet-like products to the sheet handling apparatus is insured. Advantageously, in this case, the vacuum supplied to the conveying surface is shut-off when the conveying surface comes to a standstill, so that an easy removal of the sheets from the conveying surface is insured. After sheet removal, the speed of the conveying surface is again accelerated to its initial speed corresponding to the speed of the feeding conveyor for damage-free transfer of a following sheet from the feeding conveyor onto the conveying surface of the loading device.

The device according to the present invention may be used as an unloading device of a sheet handling apparatus. In this case, the unloading device transfers the sheets, which leave the sheet handling apparatus with a zero linear speed or with a very small linear speed, to a delivery conveyor having high speed. In this device, the speed of the conveying surface is accelerated from zero speed or a speed close to zero to the speed of the delivery conveyor. As in the other types of the inventive device, the conveyed sheet firmly adheres to the conveying surface, which insures a slide-free and thereby a damage-free acceleration of the sheet.

According to the invention, it is contemplated to use, for retaining a sheet on the conveying surface, instead of suction means, magnet means, when magnetized, e.g., metal sheets are conveyed. To this end permanent magnet or electromagnet can be used. The functioning of the inventive device is the same whether suction or magnet retaining means are used.

According to the invention, the inventive device includes a drive for driving the conveying surface. The drive insures exactly reproducible jolt-free predetermined acceleration and deceleration of the conveying surface of the inventive device, as well as a synchronous operation with the associated conveyor or sheet handling means, e.g., by force-locking coupling of the drive with the drive of the associated means, e.g., associated feeding or delivery conveyor.

The control unit for controlling the drive includes a plurality of position sensors, which permit to detect an instant at which the front or rear edge of the conveyed sheet reaches a predetermined position. In accordance with the sensor-generated signals, deceleration, acceleration, vacuum application are effected.

The conveying surface of the inventive device may be formed by separate plate-like elements drivingly connected with each other. Advantageously, however, the accelerated and decelerated conveying surface is formed by a suction belt. Using a flexible belt practically eliminates a danger of any damages which are associated with the use of more solid materials. On the other hand, using a flexible belt insures a force-looking connection between sheets and the conveying surface. Specifically, it is insured that the sheets, upon application of vacuum to the conveying surface, immovably retained thereon.

According to the invention, the application of vacuum to the conveying surface does not take place during the entire operational time of the inventive device, but is controlled in accordance with the acceleration and deceleration steps. The application of vacuum to the conveying surface is effected synchronously with acceleration and deceleration of the conveying surface. With the controlled application of the vacuum, its application is turned off in the absence of the sheet on the conveying surface, which takes place during deceleration of the sluicing device or acceleration of the loading device.

BRIEF DESCRIPTION OF THE DRAWINGS

The features and objects of the present invention will become more apparent, and the invention itself will be best understood from the following detailed description of the preferred embodiment when read with reference to the accompanying drawings, wherein.

DETAILED DESCRIPTION OF THE PREFERRED EMBODIMENT

Figure 1:
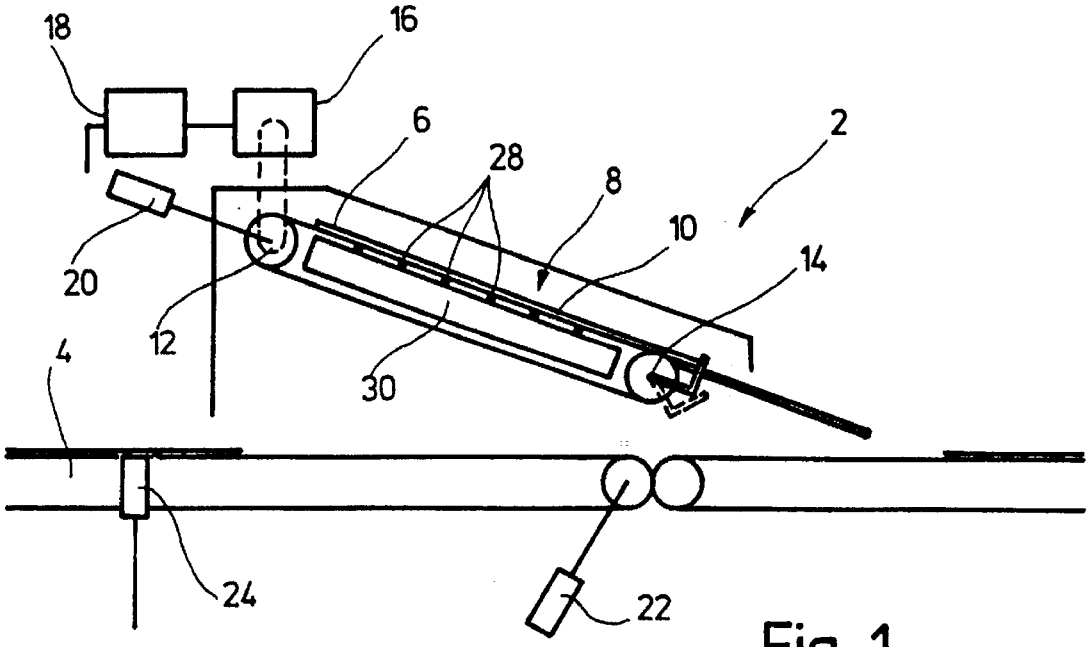
FIG. 1 is a schematic side view of a sluicing device according to the present invention.

FIG. 1 shows a sluicing device 2 according to the present invention which is arranged above a conveyor 4. In front of the sluicing device 2 in the conveying direction of the conveyor 4, there is provided a withdrawal device (not shown).

The conveyor 4 transports sheet-like products arranged thereon one after another with high speed from left to right in FIG. 1. From time to time, one of the sheet-like products or sheets 6 which are to be transported by the conveyor 4, is taken off the withdrawal device, e.g., for inspection and, after the inspection, is fed to the sluicing device 2. In the sluicing device 2, the inspected sheet 6 is retained in a wait position until the inspection of the next sheet. Upon feeding of the next sheet, the preceding sheet held in the sluicing device is accelerated and is fed to the conveyor 4.

The sluicing device 2 includes a conveying surface 8 formed by a suction belt 10. The suction belt 10 is displaced about two deflection rollers 12, 14, one of which is drivingly connected with a drive unit 16. The operation of the drive unit 16 is controlled by a control unit 18 which functions in accordance with signals received from position or speed sensors 20, 22, 24. The sensor 24 detects an empty position, which provides for transfer of a sheet from the withdrawal device to the conveyor 4, and generates an initiating reference signal, in response to which the control unit 18 actuates the drive unit 16 of the suction belt 10 of the sluicing device 2.

The suction belt 10 is provided with suction openings 28 which communicate with a vacuum chamber 30 which, in turn, communicates with a vacuum source (not shown). The sluicing device is so formed that a controlled vacuum is communicated to the vacuum chamber 30 and, thereby, to the suction openings 28. By controlling application of vacuum to the suction opening 28, it is insured that the sheet 6 is only then aspirated to the belt 10 when the speed of the belt 10 is accelerated from zero speed to a speed of the conveyor 4. The conveying surface 8 is formed in the shown embodiment of four suction belts 10 extending parallel to each other. The deflection rollers or sliding surfaces should have as smooth surface as possible. A damaged surface results in the generation of larger dynamic forces during acceleration or deceleration at the relative displacement of the belt and the rollers. These forces are transferred to a region of the suction belt 10 where no relative displacement takes place.

After the acceleration of the suction belt 10 to the drop-off speed and after the transfer of the sheet 6 to the conveyor 4, the control unit 18 decelerates the drive unit 16 and, thereby, the speed of the suction belt 10 is reduced to zero speed, and the suction belt stops. At this, the supply of vacuum to the vacuum chamber 30 and, thus, to the suction openings 28 is shut off. However, it is possible, to enable a transfer of a following sheet to the suction belt 10, to reduce the speed of the suction belt 10 to a finite value and only after the transfer of the following sheet to the wait position, to reduce the suction belt speed to zero.

Providing separate control and drive units insures high reproducibility of the acceleration and deceleration steps. Thereby, it is insured that the highest requirements of the sluicing device with regard to the cycle precision are met.

Figure 2:
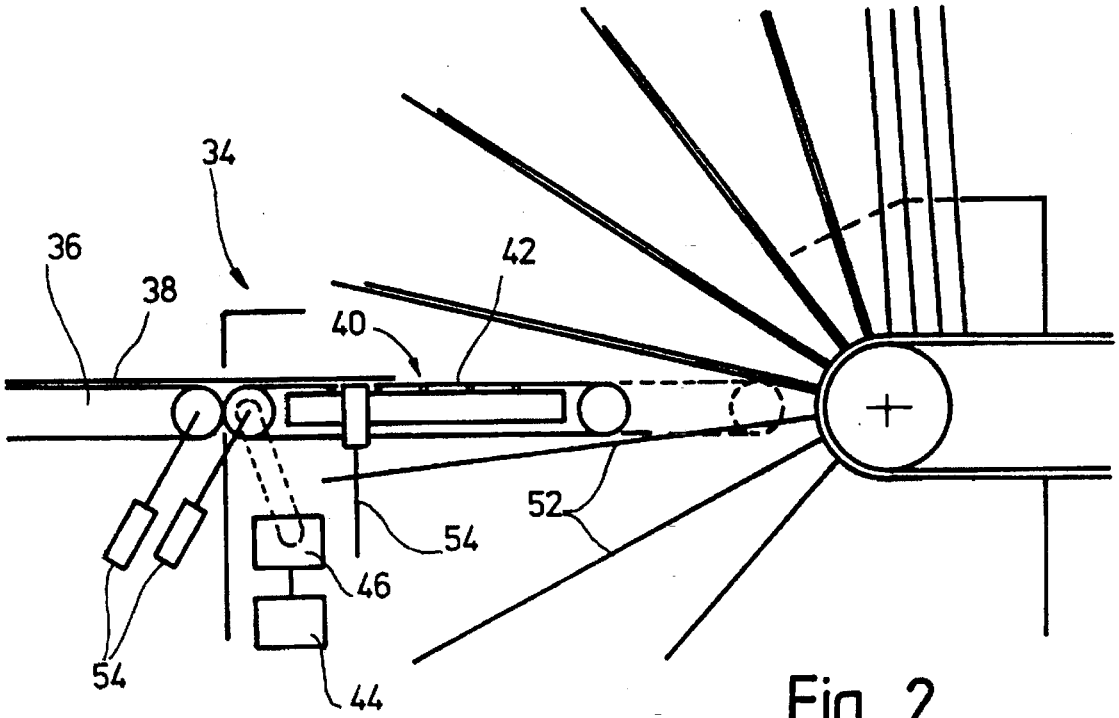
FIG. 2 is a schematic side view of a loading device according to the present invention.

FIG. 2 shows a loading device 34 according to the present invention. The loading device 34 is arranged downstream of the conveyor 36 in the transporting direction. The sheets 38 transported by the conveyor 36 with high speed are transferred onto the conveying surface 40 of the loading device 34. The conveying surface 40 is formed by a suction belt 42 provided with suction opening 43. The conveying surface 40 moves with the same speed as the conveyor 36. Immediately after the transfer of the sheet 38 onto the conveying surface 40, the control unit 44 decelerates the drive 46 of the suction belt 42 to reduce its speed from the speed corresponding to the speed of the conveyor 36 to a speed close to zero, preferably, to a stop speed. At this time, the sheet 38 is completely aspirated to the belt 42 due to the application of vacuum to the suction openings 43 of the suction belt 42. Thereby, the sheet 38 is fixedly retained on the suction belt 42, and the sheet is decelerated without any damage thereof.

The loading device, which is described above, is designated for loading of a dryer. After the suction belt 42 stops, together with the sheet supported thereon, the sheet is lifted by pivotable upward carrier lever means 52 and is displaced into a position, which is substantially transverse to its position on the suction belt 42, from which the sheet is fed to the dryer 50, at a lower speed. Advantageously, it is contemplated pivoting the carrier lever means 52 through the plane of the suction belt 42, with the sheet thereon, when the suction belt 42 has not completely stopped and before the sheet, which is carried by the suction belt 42, hits a stop, in order to lift the sheet off the suction belt 42. This prevents displacement of the sheet, when it is still aspirated to the suction belt 42, itself.

The control unit 44 controls the operation of the drive 46 in accordance with signals generated by position or speed sensors 54.

The conveying surface 40 of the loading device 34 is formed of two inner suction belts 42, extending parallel to each other, and of two outer conveying belts without suction openings. All the belts are driven by the drive 46 which operates synchronously with the conveyor 36.

Figure 3:
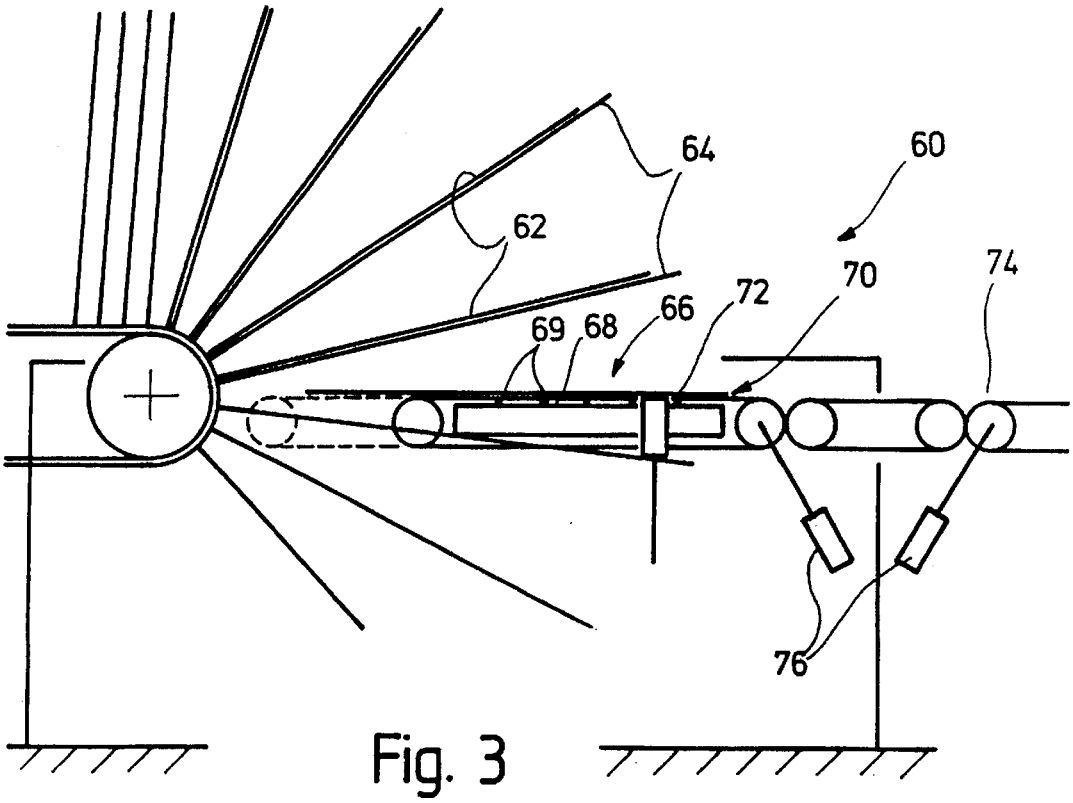
FIG. 3 is a schematic side view of an unloading device according to the present invention.

FIG. 3 shows an unloading device 60 for lifting sheets 62 delivered from a sheet treatment apparatus and for transferring the sheets further. The unloading device 60 includes a carrier lever arrangement 64 for lifting the sheets and a conveying surface 66 onto which the carrier lever arrangement 64 deposits the lifted sheets 62. As in previously described sluicing and loading devices, the conveying surface 66 is formed of a suction belt 68 provided with suction openings 69 and adapted to be accelerated very precisely to a high speed. The high speed of the suction belt 68 should be reached before the front edge 70 of a sheet 72 reaches a conveyor 74 driven with the same high speed as the high speed of the suction belt 68. After the sheet 72 has been transferred to the conveyor 74, the suction belt 68 is stopped for receiving a following sheet. The speed control of the suction belt 68 is effected in accordance with signals generated by position sensors 76.

Figure 4:
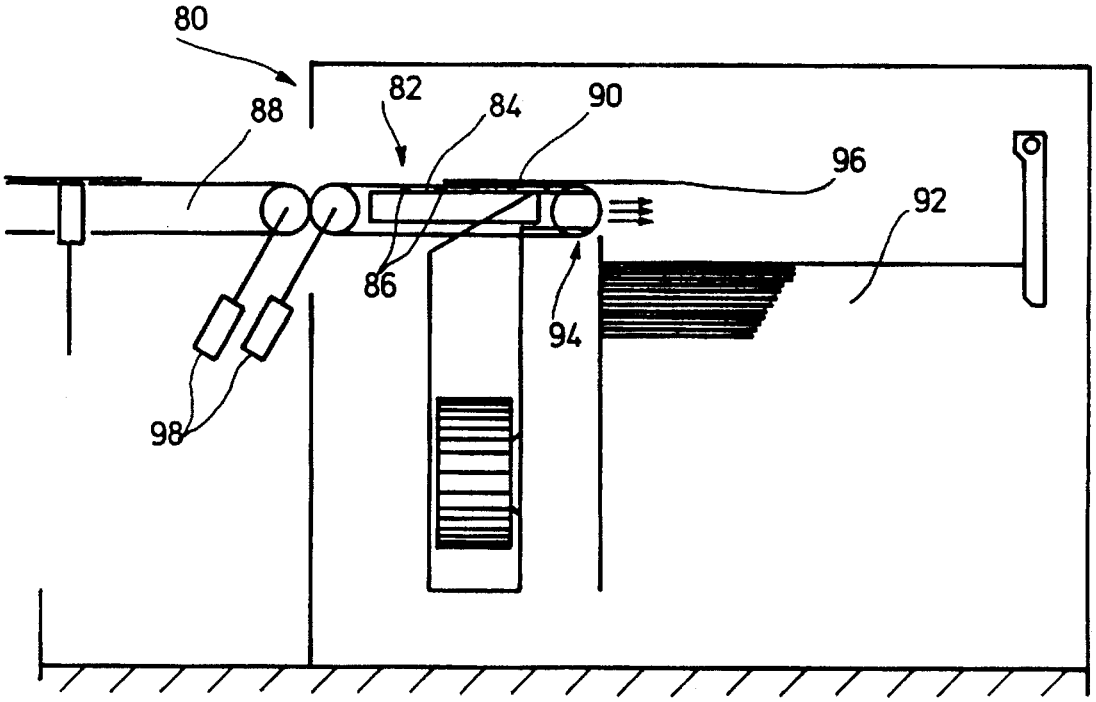
FIG. 4 is a schematic side view of a stacking device according to the present invention.

FIG. 4 show a stacking device 80 comprising an accelerating and a decelerating conveying surface 82 formed by a suction belt 84 provided with suction opening 86. After receiving sheets 90 delivered by a conveyor 88, the speed of suction belt 84, which is substantially the same as that of the conveyor 88 during the transfer of the sheets 90 from the conveyor 88 to the suction belt 84, is decelerated. The sheets 90 are aspirated to the suction belt 84 and are decelerated therewith. In order to be able to receive the maximum possible number of sheets per unit of time, the braking or decelerating process is only then starts when a half and, preferably, three fourth of a sheet leaves the suction belt 84.

Downstream of the conveying surface 82, there is provided a piling table 92 on which the sheets are stacked in a direction transverse to the sheet conveying direction. In the end region of the conveying surface 82 or immediately in front of the piling table 92, there is provided a blower 94 for creating an air pressure stream beneath a sheet transferable from the conveying surface 82 to the piling table 94. The pressure air stream creates an air cushion between the uppermost sheet of a stack already formed on the piling table 94 and the sheet fed thereto. The pressure air cushion prevents a contact between the front edge 96 of the deposited sheet 92 and the stack uppermost sheet. Thus, the sheet are stacked without any preliminary contact. Besides, the air stream provides for an accelerated deposition of the sheet rear edge.

Immediately after the deposited sheet leaves the conveying surface 82, the conveying surface 82 is accelerated to the sheet transfer speed for a damage-free reception of the following sheet.

Driving of the conveying surface 82 with a variable speed is effected in accordance with signals generated by position sensors 98 in a manner described previously with reference to other inventive devices.

Though the present invention was shown and described with reference to the preferred embodiments, various modification thereof will be apparent to those skilled in the art and, therefore, it is not intended that the invention be limited to the disclosed embodiments and details thereof, and departure may be made therefrom within the spirit and scope of the present invention as defined in the appended claims.

What is claimed is:

1. A device for linearly conveying sheet-like products, fed with first means having a first speed, to second means having a second speed different from the first speed, said device comprising:

a conveying surface provided with suction openings communicating with a vacuum source for applying vacuum to said conveying surface for retaining the sheet-like products thereon; and control means for changing a displacement speed of said conveying surface from the first speed to the second speed and, thereafter, from the second speed to the first speed, wherein the application of vacuum to said suction openings is controlled in accordance with the speed of said conveying surface.

2. A device as set forth in claim 1, further comprising drive means for driving said conveying surface with the first and second speed and controllable by said control means.

3. A device as set forth in claim 1, wherein said control means includes position sensors for determining positions of the sheet-like products conveyed on said conveying surface.

4. A device as set forth in claim 1, wherein said conveying surface comprises suction belt means.

5. A device as set forth in claim 1, further comprising means for controlling the application of vacuum to said suction openings.

* * * * *